US008888491B2

(12) United States Patent
Carter

(10) Patent No.: US 8,888,491 B2
(45) **Date of Patent: *Nov. 18, 2014**

(54) OPTICAL RECOGNITION SYSTEM AND METHOD FOR SIMULATED SHOOTING

(71) Applicant: George Carter, Dallas, TX (US)

(72) Inventor: George Carter, Dallas, TX (US)

(73) Assignee: OPTO Ballistics, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/168,951

(22) Filed: Jan. 30, 2014

(65) Prior Publication Data

US 2014/0178841 A1 Jun. 26, 2014

Related U.S. Application Data

(63) Continuation-in-part of application No. 13/611,214, filed on Sep. 12, 2012, now Pat. No. 8,678,824, which is a continuation-in-part of application No. 12/608,820, filed on Oct. 29, 2009, now Pat. No. 8,459,997.

(60) Provisional application No. 61/156,154, filed on Feb. 27, 2009.

(51) Int. Cl.
*F41G 3/26* (2006.01)
*F41A 33/00* (2006.01)

(52) U.S. Cl.
CPC ..... *F41G 3/2605* (2013.01); *F41A 33/00* (2013.01)
USPC ..... 434/19; 434/11

(58) Field of Classification Search
USPC ..... 434/11–27; 463/5, 51; 102/529; 703/6; 42/1.01
See application file for complete search history.

(56) References Cited

U.S. PATENT DOCUMENTS

| | | | |
|---|---|---|---|
| 5,215,462 | A | 6/1993 | Lewis et al. |
| 6,813,593 | B1 | 11/2004 | Berger |
| 6,899,539 | B1 | 5/2005 | Stallman et al. |
| 7,329,127 | B2 | 2/2008 | Kendir et al. |

*Primary Examiner* — Timothy A Musselman
(74) *Attorney, Agent, or Firm* — Michael Diaz

(57) ABSTRACT

A shooting simulation system and method. The system includes a firearm associated with a user having a user computer and an optical system for capturing an image. The image provides information on a trajectory of a virtual bullet fired from the firearm. The optical system is aligned relative to a known sight of the firearm and the optical system captures the image when shooting the firearm. An image recognition system determines a location where a virtual bullet from the shooting firearm would impact within the captured image.

51 Claims, 10 Drawing Sheets

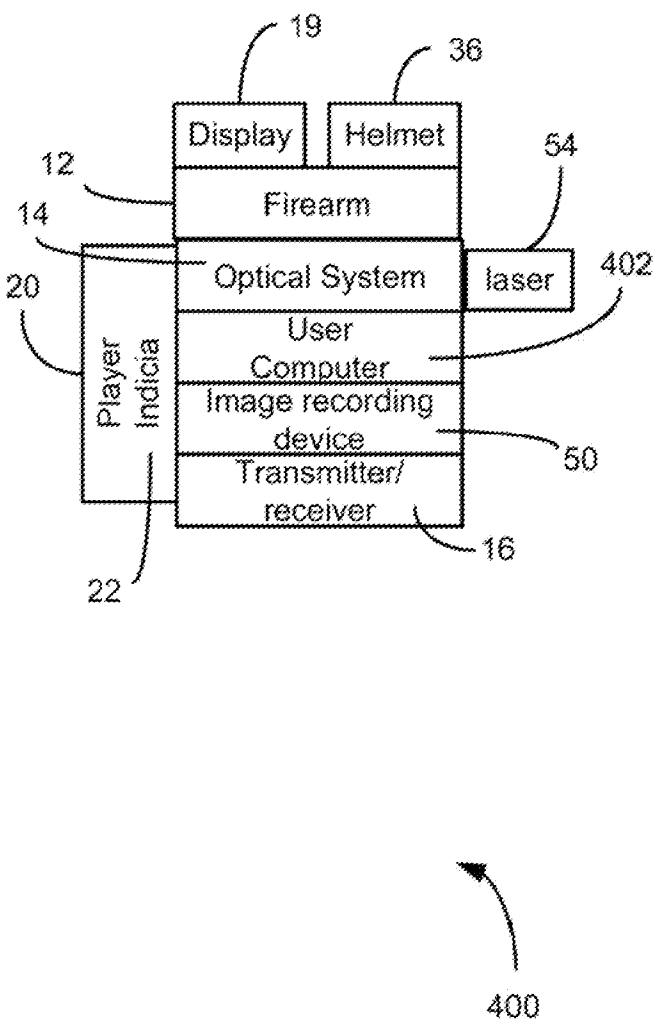
FIG. 6
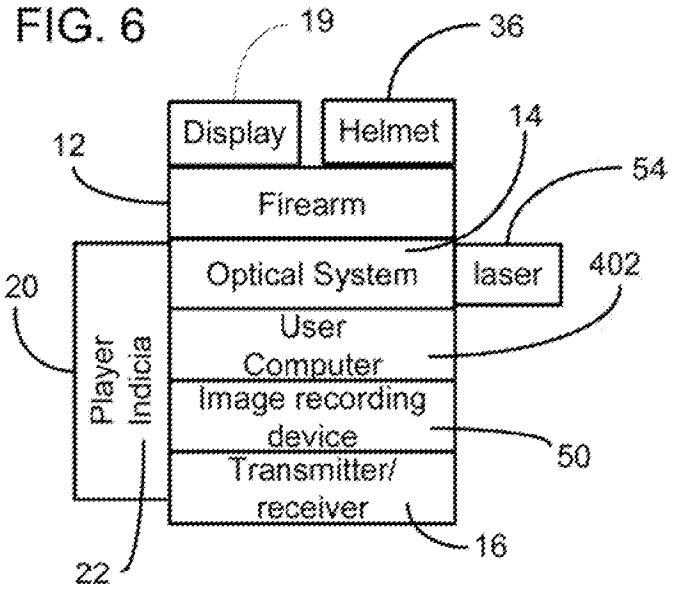

OPTICAL RECOGNITION SYSTEM AND METHOD FOR SIMULATED SHOOTING

RELATED APPLICATIONS

This application is a continuation-in-part application of co-pending U.S. patent application Ser. No. 13/611,214 entitled "Shooting Simulation System and Method Using an Optical Recognition System" filed on Sep. 12, 2012 under the name of George Carter which is a continuation-in-part application of U.S. Pat. No. 8,459,997 entitled "Shooting Simulation System and Method" filed on Oct. 29, 2009 under the name of George Carter which claims the benefit of U.S. Provisional Patent Application Ser. No. 61/156,154 fled Feb. 27, 2009 by George Carter, all of which is hereby incorporated by reference.

BACKGROUND OF THE INVENTION

1. Field of the Invention

This invention relates to simulation systems and methods. Specifically, and not by way of limitation, the present invention relates to a shooting simulation system and method.

2. Description of the Related Art

U.S. Pat. No. 8,459,997 and pending U.S. application Ser. No. 13/611,214 both disclose shooting simulation systems using an optical recognition system for use in firearm simulation systems. It would be advantageous to have a system and method which utilizes an optical recognition system defining specific hit or miss areas on a target, wherein the target may be another "player" or solder or, an inanimate object. It is an object of the present invention to provide such a system and method.

SUMMARY OF THE INVENTION

In one aspect, the present invention is directed to a shooting simulation system. The system includes a plurality of firearms. Each firearm is associated with a separate player having a user computer and an optical system associated with the firearm for capturing an image. The image providing information on a trajectory of a virtual bullet fired from a shooting firearm. The optical system is aligned relative to a known sight of the shooting firearm. The optical system captures the image when shooting the firearm and an image recognition system determines a location where a virtual bullet from the shooting firearm would impact within the captured image. The user computer then determines from the determined location of the virtual bullet if the captured image is a hit or a miss of a targeted player. The user computer uses information obtained from the optical system and image recognition system to determine if the captured image is a hit or a miss of a targeted player.

In another aspect, the present invention is directed to a method of simulating firearm use. The method begins shooting a firearm aiming at a target. Next, an image is captured by an optical system associated with the shooting firearm. The optical system captures the image when shooting the firearm. Information on a trajectory of a virtual bullet fired from a shooting firearm by the captured image is then provided and used to determine a location where the virtual bullet from the shooting firearm would impact from the captured image.

In another aspect, the present invention is directed to a shooting simulation system. The system includes a firearm associated with a user having a user computer and an optical system for capturing an image. The image provides information on a trajectory of a virtual bullet fired from the firearm.

The optical system is aligned relative to a known sight of the firearm and the optical system captures the image when shooting the firearm. An image recognition system determines a location where a virtual bullet from the shooting firearm would impact within the captured image.

BRIEF DESCRIPTION OF THE DRAWINGS

FIG. 6 is a block diagram of components of a shooting simulation system in a third embodiment of the present invention;

DESCRIPTION OF THE INVENTION

Figure 1:
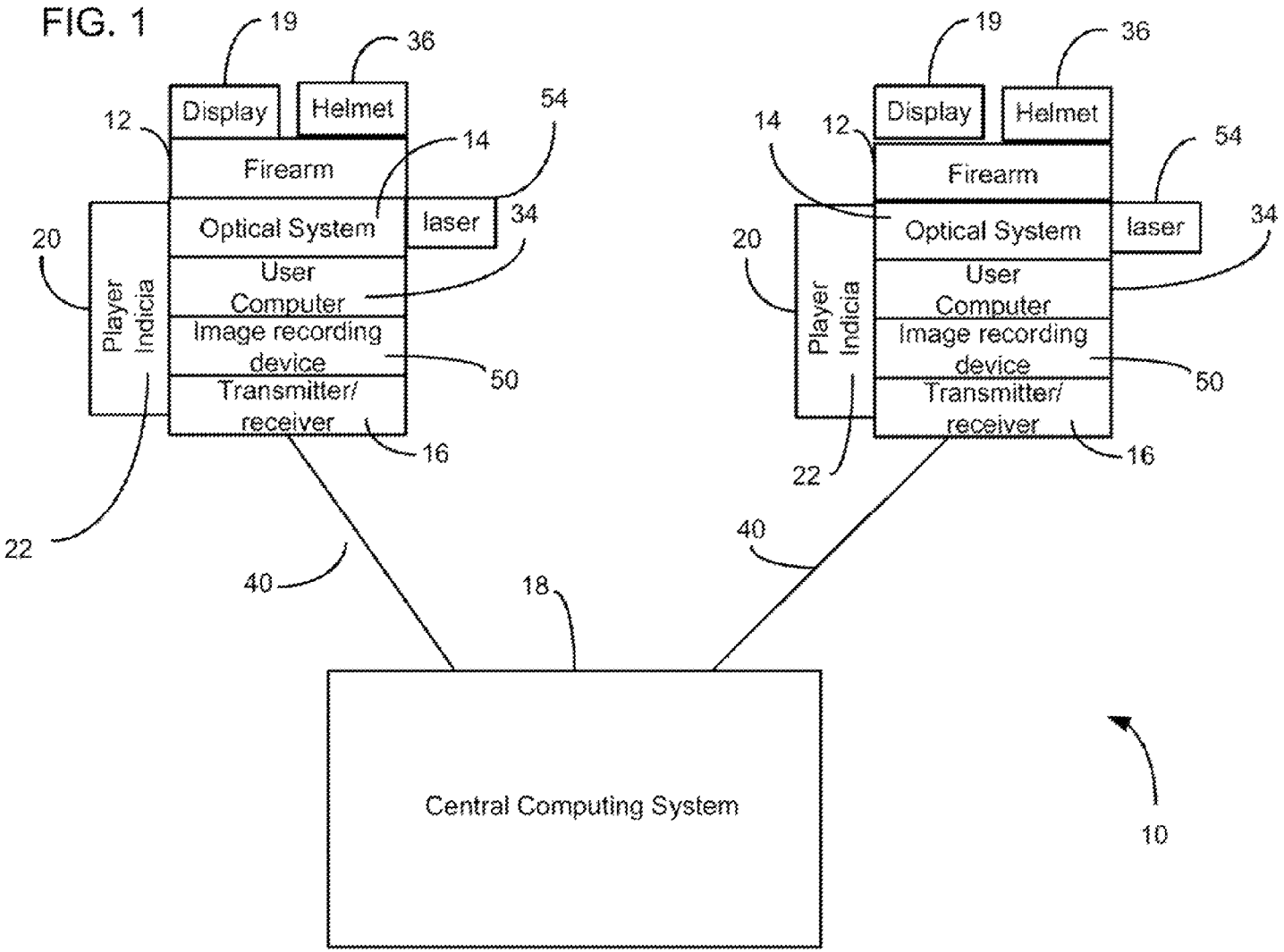
FIG. 1 is a block diagram of components of a shooting simulation system in a first embodiment of the present invention.

The present invention is a shooting simulation system and method. FIG. 1 is a block diagram of components of a shooting simulation system 10 in a first embodiment of the present invention. The system includes a firearm 12, an optical system 14, and a wireless transmitter/receiver 16. The system also includes a central computing system 18. In one embodiment, each player 20 wears an indicia 22. The indicia 22 may be any type of indicia to include color codes, bar codes, the shape of a helmet, shape of a typical person's face, infrared signatures, modulating retro-reflectors (MRRs), and other spectral images. Additionally, indicia may include the identification of a target silhouette. In this embodiment, the system 10 may be utilized in a simulated combat game having a plurality of players associated with two or more teams. In one embodiment, there are two opposing teams, where each team is attempting to obtain more "hits" against players on the opposing team.

Figure 2:
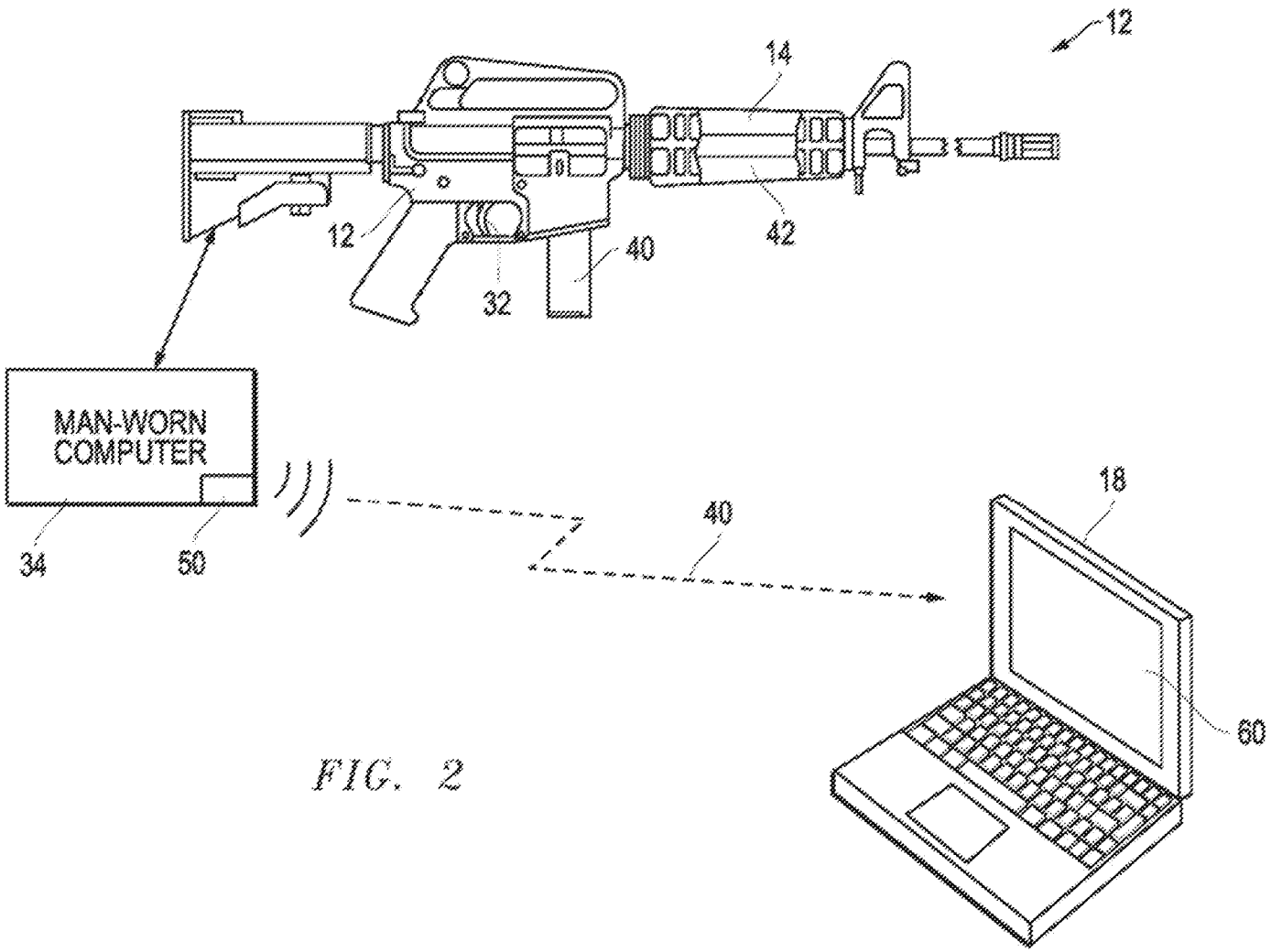
FIG. 2 is a side view of the firearm and central computing system in one embodiment of the present invention.

FIG. 2 is a side view of the firearm 12 and computing system 18 in one embodiment of the present invention. As depicted in FIG. 2, the firearm includes the optical system 14 mounted and aligned to a known sight of the gun. The firearm 12 may include a trigger 32. In addition, the user carrying the firearm may wear a user computer 34 (see FIG. 1) and an optional helmet or headset 36. The firearm may be any line of sight weapon either carried by a player or associated with a player and carried by a vehicle or other inanimate object. The user computer may be any device having a processor. The user computer may be worn or carried by the user. In addition, the user may have an optional display 19 for displaying information to the player, such as hit or miss cues, targeting of friendly or opposing player, and if a shot would be a hit if the player triggered the firearm. The display may be won or carried by the player, incorporated in the firearm or the helmet. The helmet or headset may communicate to the user computer via a wireless connection or a cable. The helmet may allow receipt of verbal instructions from the user computer or the central computing system 18. Furthermore, the helmet may allow receipt of audio special effects, such as blast noises. The wireless transmitter/receiver and optical system may also be located within the user computer or integrated within the firearm 12. The user computer includes components which may or may not be separate from the firearm. If the user computer is separate from the firearm, the firearm communicates with the user computer through a cable or wireless link. In another embodiment, all or some of the components of the user computer are integrated into the firearm. The firearm may be any type of weapon, such as a pistol, rifle, shotgun, rocket propelled grenade launcher (RPG), bazooka, "phaser" (ray gun based on science fiction) used in "laser tag" type games, or any other line-of-sight weapon carried by an individual or mounted upon a vehicle. The firearm may be an authentic replica weapon or an operable weapon having the optical system, and transmitter/receiver mounted to the weapon. Additionally, the firearm may be attached to a vehicle, such as a tank, jeep, aircraft, watercraft, etc. The wireless transmitter/receiver may be any device which transmits and/or receives data via a communications link 40 to the central computing system, such as a standard 801.11b wireless connection, a Bluetooth connection, etc. In addition, the optical system 14 or user computer may include a rangefinder 42, such as lidar, for ranging the distance from the firearm to the target. Additionally, each firearm, through the optical system, may emit an infrared or laser beam or any type of spectral or visible light (beam) in several directions from the firearm. This emitted beam may be used for verification or identification of an actual target. In one embodiment, the firearm may emit a forward spectral radiation (e.g., infrared, laser ultra-violet) to illuminate a target's indicia having a spectral reflective material. Additionally, the firearm may emit a laser for use in ranging a target, interrogating a target or illuminating the target. In the embodiment where the optical system includes a laser or other forward spectral radiation mechanism, the optical system utilizes a receiver to receive any reflected signals. The target may be a player or a vehicle, such as a tank, watercraft, aircraft, or vehicle for which the player is located. For example, when the player actuates the trigger, the presence of the beam from the target's firearm may be used for identification or verification of a valid target. Thus, the player may shoot or be shot directly at another player or by a vehicle (including aircraft, watercraft, or tank). Thus, the present invention may be used for military exercises using virtual munitions. In this discussion, bullets may include any line of sight munitions, projectile or bullet.

The optical system 14 includes an image recording device 50 (see FIG. 1) and an optical image capturing device (mounted on the firearm) which captures an image when the trigger is actuated. The optical system is aligned relative to a known orientation or sight of the firearm and captures an image when the trigger 32 is actuated. The image is then captured and recorded by the optical system in the image recording device 50. The optical system may also include an image recognition program or system. The optical system may optionally include ballistic data for bullets which would be fired from the firearm. The optical system 14 may be located in the firearm or portions of the optical system, with the exception of the optical image capturing device, may be separate from the firearm but carried by the player (e.g., in the user computer). The optical system may be incorporated with the user computer 34 in one or more devices. In one embodiment, the optical system and/or user computer are incorporated in a smart mobile phone.

The optional image recognition program may reside in the firearm 12 or user computer to determine where a firearm's virtual bullets would impact relative to the intended target. Furthermore, it may be determined if a hit or miss is awarded for the captured image based on recognition of a target from the optional image recognition program. The image recognition program may process the image by determining if the captured image is recognized as a legitimate target, such as a human figure or target vehicle. Additionally, the image recognition program may utilize motion of the object to determine if the target is a legitimate target. In addition, the image recognition program may utilize silhouette extraction techniques of targets (e.g., soldiers, vehicles, human forms, etc.) to determine and recognize a target. For instance, silhouette extraction of targets may be obtained by utilizing computer vision techniques as well as ancillary identifiers, such as helmets, gun shape, vehicle features, etc.

The user computer may also include an aural system, which may be incorporated in the firearm itself or the helmet or headset 36 worn by the player. The aural system may provide an indication of when a hit has been scored against the player, near miss cues (e.g., up/down, high/low verbal warnings or displays on a screen associated with the firearm), a realistic noise simulating the firing of a gun, or bullets approaching. The aural system may also provide a verbal call of the accuracy of the shot, such as "miss", "hit", or "miss high/low". Furthermore, the firearm may include a Light Emitting Diode (LED) array or other illumination system which illuminates when the trigger is actuated to simulate a muzzle blast. The firearm may also utilize machine recognizable markings which provide an identification of the gun. In addition, the firearm may utilize multiple optical sets for long or short range. The optical system may also utilize an infrared system, night vision system, or other spectral imaging system for use at night or in reduced visibility. In one embodiment, at or near when the trigger is actuated on the firearm, the firearm may emit a forward spectral radiation (e.g., visible, infrared or ultra-violet) to illuminate a target's spectral reflective indicia. The user may then be informed that the target is friendly by the display 19 carried or worn by the user or incorporated in the firearm or a helmet audio. Additionally, in another embodiment, even prior to the trigger actuation, the user computer may provide an indication of a valid target or an indication if the trigger was to be actuated if a hit or miss would be scored.

The optical system may determine, through its image recognition program or system, if the image is a recognizable target (e.g., a human form). The optical system may utilize several sources of information to verify the validity of the target. Furthermore, the optical system may include ballistic data of a projected firing of a bullet or other type of projectile utilized by the firearm to determine where the bullet would hit. The presence of the indicia 22 or a detected infrared emission (e.g., heat) of the opposing player also may be used to identify a target. Furthermore, the optical system may utilize other mechanisms for detecting other types of spectral images. In one embodiment, the central computer or user computer (processor) may know the range between the firearm and the target. In addition, the rangefinder (e.g., lidar) may optionally be used to determine an accurate projected trajectory of the bullet (i.e., the bullet ballistics) for the particular target at a determined range. As discussed above, the determination of where a virtual bullet would hit, and thus determine a hit or miss within the optical system may utilize various forms of data. The orientation of the gun which may include the inclination of the firearm, the distance to the target, weather conditions (wind, altitude, etc.), movement of the gun, etc. are all used to determine the trajectory of the bullet. The calculated bullet's trajectory is then used to determine where the bullet would have hit, and from the determination of the bullet's virtual position relative to the intended target, a determination of a hit or miss may be accomplished. Thus, the present invention may be utilized to accurately determine the position where the virtual bullet would impact relative to the target, and thereby determine if it is a hit or miss. A hit may be defined by predetermined constraints, which may be stored in the user computer for determining a hit. For example, a hit may need to "hit" a specific percentage of the target. The user computer 34 may utilize various navigation and motion systems to collect data for accurate determination of the bullet's trajectory and/or location of the player, such as GPS or INS. The optical system, in the optical image recording device 50, then records the captured image as a hit or a miss based on the image recognition programs determination. This information may then be transmitted to the central computing system via the communications link 40. The transmittal of this data may be at a predetermined time period or by a command issued from the central computing system. The optical system may capture one or more images at or near trigger actuation, specifically during the act of shooting the firearm. The action of shooting the firearm typically includes the time period prior to trigger actuation for aiming, actuating the trigger, and a momentary time afterward. The optical system may determine that a trigger actuation is imminent in a wide variety of ways, such as utilizing accelerometers to determine when a firearm is motionless, which is typical prior to trigger actuation. Thus, the optical system may determine that trigger is imminent and begin capturing images. If the trigger is not actuated by a predetermined time period, the image or images may then be discarded.

In one embodiment, the captured image or images and any relevant data are sent to the central computing system 18 via the wireless communication link 40. The central computing system may include a display screen 60 and a receiver (not shown) to receive the transmitted image and relevant data. The central computer may provide the functionality to manage a wireless network encompassing the plurality of players 20 having firearms 12. The central computing system may know where each player is located, the heading and inclination of the barrel, the distance from the firearm to the target and utilize this information to provide further verification of whether an attempted shot is a valid hit by considering the geometry of the bullet trajectory and the position of the target. Although the central computing system may determine a hit, the image recognition system may ascertain that a valid target is not in the captured image. This would occur if a player is located behind an object, preventing the passage of the bullet to the target. The central computing system may provide overall control of a game, such as providing the type of game being played, the control of the time of the game (e.g., start and stop time of the game, etc.), and handicapping of the players using smaller concentric circles within a reticle of the optical system for scoring a hit of a target. Furthermore, images captured by the image recording device 50 may be transmitted to the central computer, which in turn, may be displayed or printed for the player's review.

In one embodiment, the present invention may utilize modulating retro-reflectors as indicia. For example, modulating retro-reflectors may be placed on targets, such as other players, vehicles, buildings, etc. The optical system may utilize a laser 54 (e.g. lidar) or other spectral emitting device to transmit a light beam to the target. The modulating retro-reflectors are illuminated and reflect back a modulated light beam to a receiver on the optical system. The reflected modulated light may be utilized to identify the target. Additionally, the modulating retro-reflectors may be placed on specific areas of the target (e.g., right shoulder) to provide an indicator for placing where the target was hit. Additionally, the modulating retro-reflectors may be used to assist in illuminating a portion or points on a target, especially in low light scenarios. In such a circumstance, the laser illuminates the modulating retro-reflectors which then illuminate points on the target or a portion of the target. The optical system may then extract the target using silhouette extraction techniques. Thus, the modulating retro-reflectors may be utilized to identify a target and/or assist in extracting a silhouette from the image.

With reference to FIGS. 1 and 2, the operation of the system 10 will now be explained. A plurality of players 20 enters an area of operation. Each player carries a firearm 12 and user computer. In one embodiment of the present invention, each player wears the indicia 22 to facilitate ease in recognition by the optical system's recognition program of a legitimate target and which team the player is affiliated. Furthermore, the indicia 22 may be used to individually identify each player. In one embodiment, the indicia may include a spectral reflective indicia or modulating retro-reflector which reflects spectral illumination emitted by the firearm. A player observes another player on the opposing team, aligns the firearm in a similar fashion as if the player was aiming the firearm to actually fire. The player, upon determining that the firearm is correctly aimed, actuates the trigger 32. In one embodiment, the user computer may provide a target indicator, prior to the trigger actuation, providing an indication if the image in the optical system is a valid target (e.g. friend or foe) or if it would be a hit or miss. The optical system 14 captures the image or images and optionally any relevant data related to the estimated trajectory of the bullet (e.g., wind, altitude, motion, etc.) during the act of shooting. The captured image is then processed within the user computer, which then computes a position of where the virtual bullet would hit and thus determine a hit or miss of the intenced target (e.g., player or vehicle).

The image recognition program/system may determine if the image is a recognizable target (e.g., a human form or vehicle). The optical system or user computer may utilize several sources of information to verify the validity and/or identification of the target. Furthermore, the optical system may optionally include ballistic data of a projected firing of a bullet to determine where the bullet would hit. The presence of the indicia 22 or a detected infrared emission (e.g., heat) of the opposing player may be used to determine if the target is a valid target. Furthermore, the optical system may utilize other ancillary identifiers to determine if the intended target is valid, such as detecting specific patterns, spectral light reflected from an indicia having spectral reflective material, color, or shapes (e.g., color, helmet, human face, assault rifle, camouflage clothing, boots, etc.). In addition, the rangefinder may optionally be used to determine an accurate projected trajectory of the bullet (i.e., the bullet ballistics) for the particular target at a determined range. In one embodiment, the range may be determined by the image size of know elements of the indicia. For example, a triangle on the indicia may be two inches long. When the image is captured, the indicia in the captured image has a smaller size at a specific distance and a larger size at a closer distance. The user computer may calculate the distance by using the size of the known element of the indicia in the captured image. In addition, the optical system may utilize other mechanisms for detecting other types of spectral images of the intended target. For example, the target may wear modulating retro-reflectors to illuminate or identify the target or specific areas of the target (e.g., a head, shoulder, leg, etc.) As discussed above, the determination of where the virtual bullet hits within the optical system may utilize various forms of data. The inclination and orientation of the barrel of the gun, distance to the target, weather conditions (wind, altitude, etc.), movement of the gun, etc. are all used to determine the trajectory of the bullet. The calculated bullet's trajectory is then used to determine where the bullet would have hit, and from the determination of the bullets destination, a determination of a hit or miss is accomplished. The firearm may utilize various navigation and motion systems to collect data for accurate determination of the bullet's trajectory and/or location of the player, such as GPS or INS. The optical system then records the captured image as a hit or a miss based on the image recognition programs determination. This information may then be transmitted to the central computing system via the communications link 40. This data, as well as the location of the firearm, the heading and inclination of the barrel, and distance from the firearm to the target, may be sent at a predetermined time period or by a command issued from the central computing system.

The central computing system receives this data and may independently determine/verify a hit or miss of the target. Since the central computing system includes the position of each player and the information on the triggered firearm (e.g., heading and inclination of barrel, distance to target, etc.), the central computing system may determine/verify a hit or miss. The central computing system then manages the location of all the players as well as compiling all the hits and misses of each player at a specific location and time during the simulation. This compilation may be used for debrief of the players and determination of the success of each player and each team. The central computing system may compile such data as time of firing, accuracy, number of bullets fired, times the player is targeted, etc. In one embodiment, the central computing system may provide a playback of each encounter providing a graphical representation of each player, trajectory of the bullets, etc. In addition, the computing system may capture images which are enhanced by infrared detection or night vision systems enabling optical image pickup in reduced visibility. These images may be downloaded to other computer devices or printed. Furthermore, the central computing system may send back information on a hit or miss to the intended target. For example, the target (player) may be informed that he is killed by receiving an aural warning in a headset. In addition, the central computing system or user computer may determine a size or pattern of what is defined as a "hit" or "miss". For example, a confirmed "hit" may be reduced to a smaller pattern (e.g., a smaller concentric circle or circles for which a hit is scored). Additionally, the central computer or the user computer may provide a handicap based on previous performance of the player for the determination of a hit. For example, concentric circles in a reticle of the optical system may be smaller for an "expert" player and have a larger concentric circle to score a hit for a "novice player". The central computer may determine handicaps and narrow the scope of a hit or miss dependent upon the skill level of the player.

The present invention may also utilize an aural system to alert a player that the player has been hit or provide realistic sounds during the course of the game (e.g., firing of the firearm or bullets passing in close proximity to the player). Additionally, the shooting player may be informed of hitting the target or miss cues (e.g., high/low, left/right, etc.). The present invention may also include a Light Emitting Diode (LED) array or other illumination system which illuminates when the trigger is actuated to simulate a muzzle blast or when the player has been hit.

The optical system of an opposing force, simulating an untrained person having lower marksmanship skills may be degraded to a predetermined amount to simulate the degraded abilities of the opposing team in an actual situation. For example, if the opposing player is simulating a terrorist or criminal with limited firearms training, the optical system may program a degraded hit calculation to emulate the reality of the degraded capability of the player.

Figure 3A:
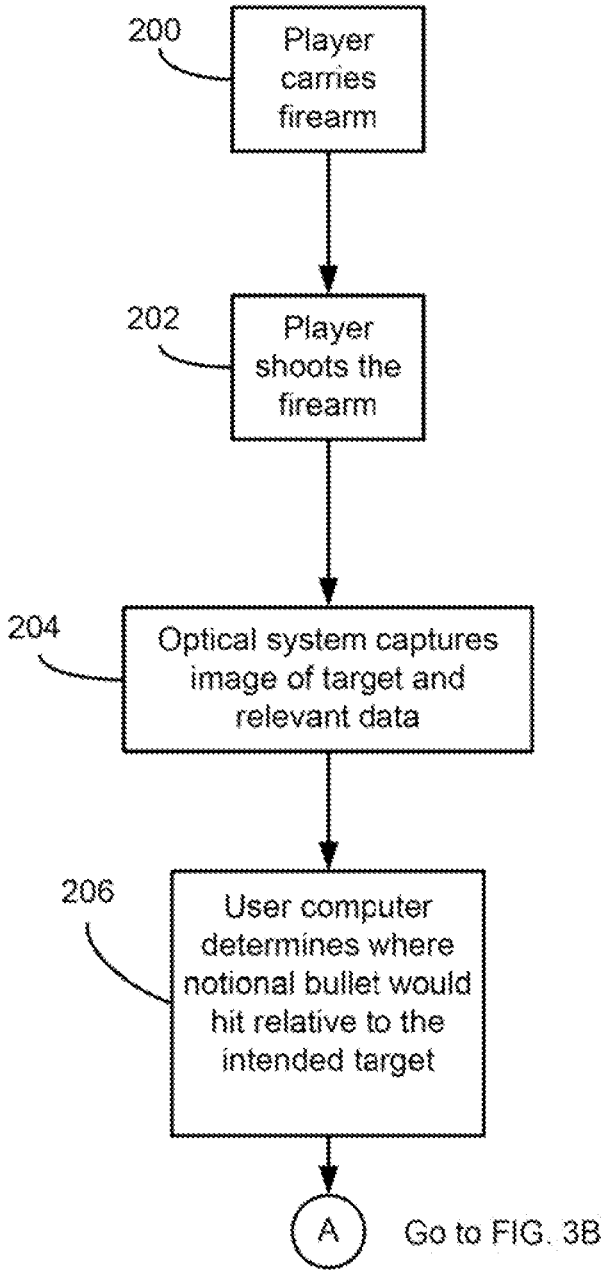
FIGS. 3A and 3B are flow charts illustrating the steps of simulating firearm use in a scenario according to the teachings of the present invention.
Figure 3B:
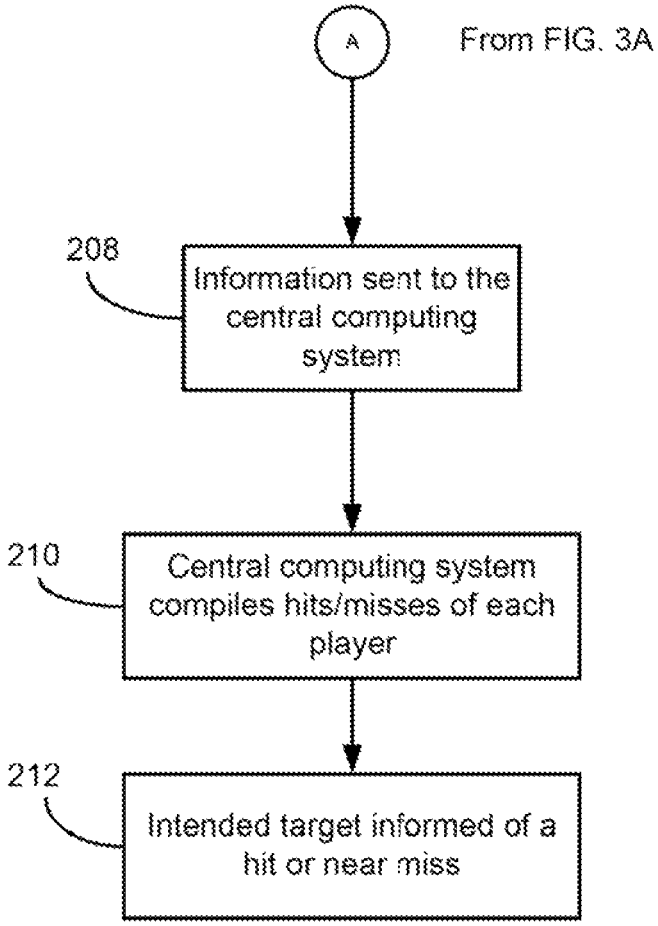

FIGS. 3A and 3B are flow charts illustrating the steps of simulating firearm use in a scenario according to the teachings of the present invention. With reference to FIGS. 1-3, the method will now be explained. In step 200, each player carries a firearm 12 and the user computer 34. In one embodiment of the present invention, each player may wear the indicia 22 and may transmit light or other spectral beams to facilitate ease in recognition by the optical system's recognition program of a legitimate target. Next, in step 202, a player observes another player (or target) and when desired, shoots the firearm by aligning the firearm in a similar fashion as if the player was aiming the firearm to actually fire and actuates the trigger 32. In step 204, the optical system 14 captures the image or images during the act of shooting the firearm (i.e., prior to trigger actuation, during trigger actuation, and/or immediately after trigger actuation).

In step 206, the user computer determines where the virtual bullet would have impacted in relation to the target. From this information, it can be determined whether to score it as a hit or a miss. Furthermore, the present invention may utilize various sources of information to identify the target, such as the indicia (e.g., modulating retro-reflector, pattern on clothing, etc.). The user computer may utilize several sources of information to determine where the virtual bullet or projectile would hit relative to the intended target. For example, the user computer may include ballistic data of a projected firing of a bullet to determine where the bullet would hit. The presence of the indicia 22 or a detected infrared emission (e.g., heat) or reflected laser beam from the opposing player may be used to determine the identity and thus, if the target is a valid target. In addition, the rangefinder may optionally be used to determine an accurate projected trajectory of the bullet (i.e., the bullet ballistics) for the particular target at a determined range. As discussed above, the determination of a hit or miss within the optical system may utilize various forms of data. The orientation (e.g., heading and inclination) of the barrel of the firearm, distance to the target, weather conditions (wind, altitude, etc.), movement of the firearm, etc. may all optionally be used to determine the trajectory of the bullet. Furthermore, modulating retro-reflectors may be optionally utilized to identify or illuminate the target as well as assist in determining the position of where the virtual bullet would have hit. Silhouette extraction techniques may also be utilized to extract an intended target and determine the identity and/or validity of the target. The computer within the firearm may utilize various navigation and motion systems to collect data for accurate determination of the bullet's trajectory and/or location of the firearm, such as GPS or INS. The user computer then records the captured image as a hit or a miss based on the image recognition programs determination. Furthermore, the optical system may utilize other ancillary identifiers to determine if the intended target is valid, such as detecting specific patterns (e.g., helmet, human face, assault rifle, camouflage clothing, boots, etc.).

Next, in step 208, this information (i.e., trigger actuations, results, etc.) may then be transmitted to the central computing system via the communications link 40. The transmittal of this data and optionally as well as the location of the player may be at a predetermined time period or by a command issued from the central computing system.

In step 210, the central computing system then manages the location of all the players as well as compiling all the hits and misses of each player at a specific location and time during the simulation. This compilation may be used for debrief of the players and determination of the success of each player and each team. The central computing system may compile such data as time of firing, accuracy, number of bullets fired, times the player is targeted, etc. In one embodiment, the central computing system may provide a playback of each encounter providing a graphical representation of each player, trajectory of the bullets, etc. In addition, the central computing system may independently determine/verify a hit or miss of the target. Since the central computing system includes the position of each player and the information on the triggered firearm (e.g., heading and inclination of barrel, distance to target, etc.), the central computing system may determine/verify a hit or miss. In step 212, this verification of a hit or miss may be sent back to the intended target (i.e., the targeted player) to inform of a hit or a miss.

Figure 4:
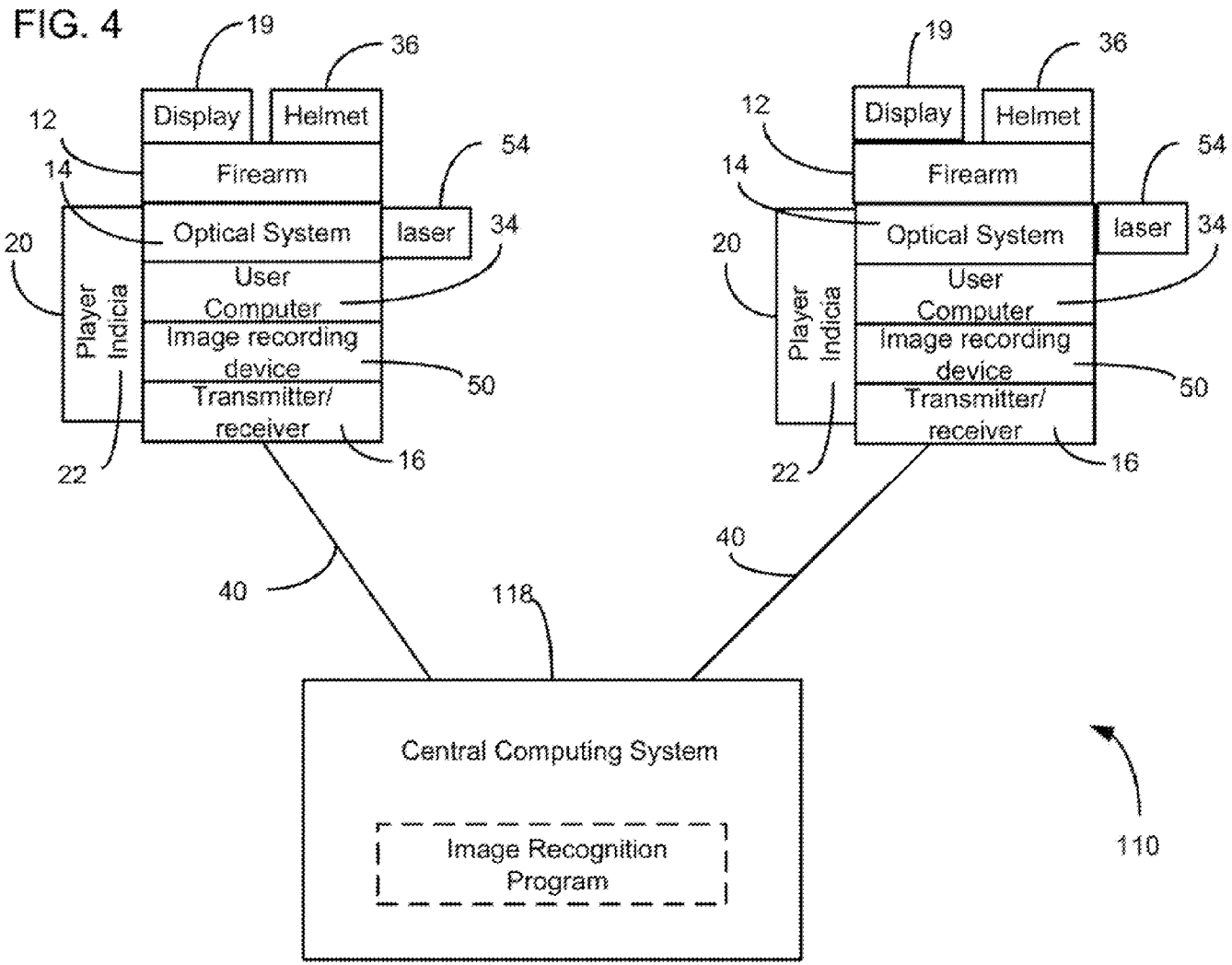
FIG. 4 is a block diagram of components of a shooting simulation system in a second embodiment of the present invention.

In another embodiment, the image recognition program and the functionality to determine where a virtual bullet would hit relative to the intended target, and thereby determine if it is a hit or miss may reside in the central computing system. FIG. 4 is a block diagram of components of a shooting simulation system 110 in a second embodiment of the present invention. The system includes the firearm 12, the user computer 34, the optical system 14, the optional display 19, and the wireless transmitter/receiver 16. The system also includes a central computing system 118. In one embodiment, each player 20 wears an indicia 22. The system 110 may include all or some of the components discussed for the system 10. The system 110 may operate in the same manner as discussed for the system 10 with the exception of the central computing system determining where the virtual bullet hits relative to the intended target.

As discussed in FIGS. 1 and 2, the optical system aligns where a bullet would travel in front of the firearm and captures an image when the trigger 32 is actuated. The image or images are then captured and recorded in the image recording device 50 during the act of shooting. The optical system 14 may be located in the firearm or portions of the optical system, with the exception of the optical image capturing device, may be separate from the firearm but carried by the player (e.g., in the user computer).

In the embodiment illustrated in FIG. 4, the captured image or images and any relevant data are sent to the central computing system 18 via the wireless communication link 40. The central computing system may include a display screen 60 and a receiver (not shown) to receive the transmitted image and relevant data. The central computer provides management of a wireless network encompassing the plurality of players 20 having firearms 12. The central computing system also records results of hits and misses of targets. Furthermore, the central computing system includes the image recognition program that determines if a hit or miss is awarded for the captured image. In particular, the image recognition program residing within the central computing system may process the image or images by determining if the captured image is recognized as a legitimate target, such as a human figure or target vehicle as well as determining a location of where the virtual bullet would hit relative to the target.

The present invention may optionally utilize indicia 22 reflecting light from the target to identify the target. In addition, in a similar fashion as the system 10, information may be obtained from several sources and utilized to determine where the virtual bullet would hit relative to the intended target. In particular, the central computing system may receive information on the location of each firearm, the heading and inclination of the barrel of the firearm, the distance from the firearm to the target and the location of other firearms. All this geometric information may be used to determine if a hit or miss is to be scored. Furthermore, the central computer may utilize other ancillary identifiers to determine where the bullets/projectiles would hit relative to the intended target, such as utilizing modulating retro-reflectors, detecting specific patterns (e.g., helmet, human face, assault rifle, camouflage clothing, boots, etc.). Additionally, the optical system may emit spectral radiation (e.g., laser beams) which is reflected off of indicia having spectral reflective material. The spectral radiation may be reflected off the reflective material to a receiver in the optical system and provide an indication of the targeted player. In addition, the central computing system or user computer may vary the parameters defining a valid hit. For example, a hit may be reduced to a smaller pattern (e.g., a smaller concentric circle or circles for which a hit is scored). Additionally, the central computer or the user computer may provide a handicap based on previous performance of the player for the determination of a hit. For example, an "expert" player may have one or more smaller concentric circles within a reticle of the optical system for scoring a hit of a target relative to other players.

In one embodiment, the present invention may utilize modulating retro-reflectors. For example, modulating retro-reflectors may be placed on targets, such as other players, vehicles, buildings, etc. The firearm may utilize a laser 54 (e.g., lidar) or other spectral emitting device to transmit a light beam to the target. The modulating retro-reflectors are illuminated and reflect back a modulated light beam to the receiver of the optical system. The reflected modulated light may be utilized to identify the target. Additionally, the modulating retro-reflectors may be placed on specific areas of the target (e.g., right shoulder) to provide an indicator for placing where the target was hit. Additionally, the modulating retro-reflectors may be used to assist in illuminating points on the target or a portion of a target, especially in low light scenarios. In such a circumstance, the laser illuminates the modulating retro-reflectors which then may illuminate points or a portion of the target. The optical system may then extract the target using silhouette extraction techniques. Thus, the modulating retro-reflectors may be utilized to identify a target and/or assist in extracting a silhouette from the image.

With reference to FIGS. 2 and 4, the operation of the system 110 will now be explained. A plurality of players 20 enters an area of operation. Each player carries a firearm 12 and the user computer 34. In one embodiment of the present invention, each player wears the indicia 22 to facilitate ease in recognition by the optical system's recognition program of a legitimate target and which team the player is affiliated. A player observes another player on the opposing team, aligns the firearm in a similar fashion as if the player was aiming the firearm to actually fire. The player, upon determining that the firearm is correctly aimed, actuates the trigger 32. The optical system 14 captures the image or images and any relevant data related to the estimated trajectory of the bullet (e.g., wind, altitude, motion, etc.) during the act of shooting. The action of shooting the firearm typically includes the time period prior to trigger actuation for aiming, actuating the trigger, and a momentary time afterward. The optical system may determine that a trigger actuation is imminent in a wide variety of ways, such as utilizing accelerometers to determine when a firearm is motionless, which is typical prior to trigger actuation. Thus, the optical system may determine that trigger is imminent and begin capturing images. If the trigger is not actuated by a predetermined time period, the image or images may then be discarded. In one embodiment, the captured image or images and relevant data is transmitted by the transmitter/receiver 16 to the central computing system 118 via the communications link 40. The user computer may also transmit the location of the firearm and the heading and inclination of the barrel of the firearm (determined by GPS or INS) and the distance from the firearm to the target (determined by the rangefinder) to the central computing system.

The central computing system receives the transmitted captured image or images and may determine through the image recognition program residing with the central computing system, if the image is a recognizable target (e.g., a human form). Furthermore, if the indicia 22 of the opposing player are used, the image recognition program can easily determine to which side the player is aligned as well as the individual player's identity. Furthermore, the position where the virtual bullet would have impacted relative to the intended target is determined and thereby used for determining a hit or miss. The central computing system 18 then records the captured image as a hit or a miss based on the image recognition program's determination. Furthermore, the central computing system may further verify if a hit or miss is to be scored by utilizing the positional information of the virtual bullet relative to the intended target. The management of scores of hits and misses are then compiled by the central computing system. This compilation may be used for debrief of the players and determination of the success of each player and each team. The computing system may compile such data as time of firing, accuracy, number of bullets fired, times the player is targeted, etc. In one embodiment, the computing system may provide a playback of each encounter providing a graphical representation of each player, trajectory of the bullets, photos, etc. In addition, the computing system may capture images which are enhanced by infrared detection or night vision systems enabling optical image pickup in reduced visibility. The central computing system may send the captured images to other computing devices or printed as desired. The central computing system or user computer may provide hit/miss cues to the shooting player through display of information on the display 19 or through the aural system. In addition, the computing system may provide an indication of a hit or miss to the intended target.

The determination of where the virtual bullet would hit relative to the target is made within the central computing system 18 or optionally within the user computer 34 using various forms of data. The inclination of the gun, distance to the target, weather conditions (wind, altitude, etc.), movement of the gun, distance from firearm to target obtained from the rangefinder, etc. may optionally be used to determine the trajectory of the bullet. The calculated bullet's trajectory may also be used to determine where the bullet would have hit, and from the determination of the bullet's destination, a determination of a hit or miss of a valid target is accomplished. A hit may be defined by predetermined constraints, which may be stored in the user computer or central computing system for determining a hit. As discussed above, the firearm may utilize various navigation and motion systems to collect data for accurate determination of the bullet's trajectory and/or location of the player, such as GPS or INS.

Figure 5A:
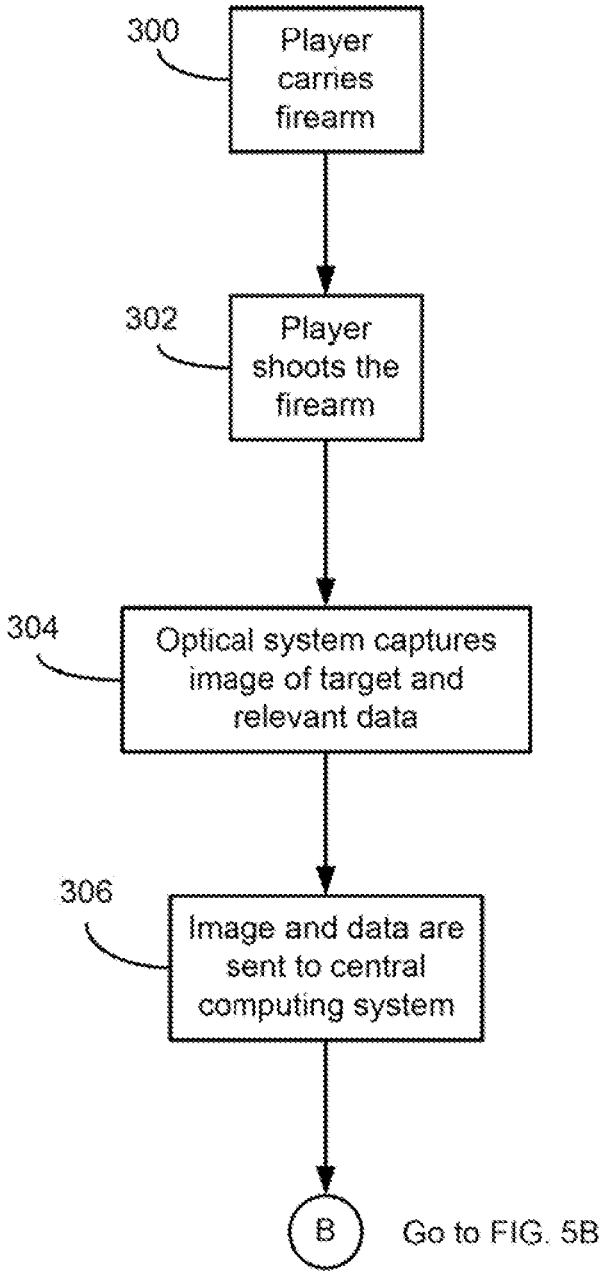
FIGS. 5A and 5B are flow charts illustrating the steps of simulating firearm use in a scenario in another embodiment of the present invention.
Figure 5B:
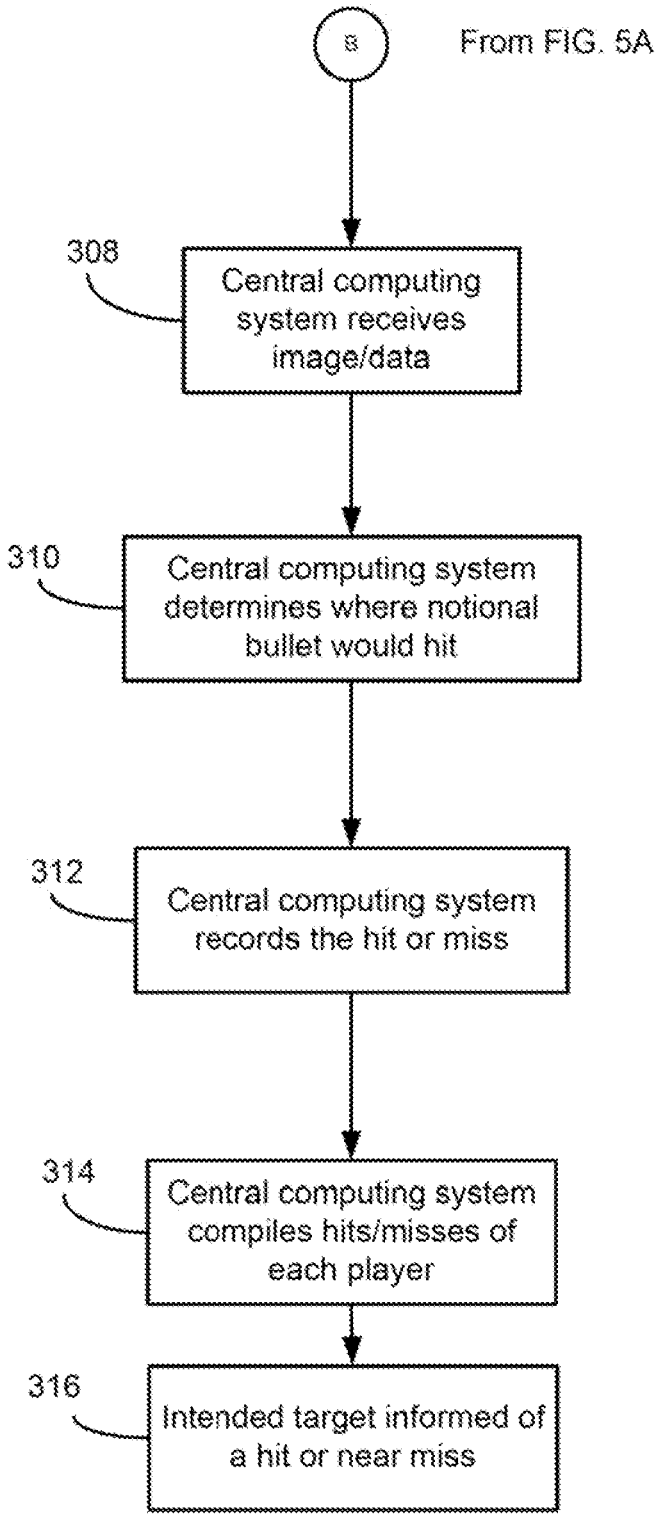

FIGS. 5A and 58 are flow charts illustrating the steps of simulating firearm use in another embodiment of the present invention. With reference to FIGS. 2, 4, and 5, the method will now be explained. In step 300, each player carries a firearm 12 and the user computer 34. In the preferred embodiment of the present invention, each player may wear the indicia 22 to facilitate ease in recognition by the optical system's recognition program of a legitimate target and to which team the player is affiliated. Next, in step 302, a player observes another player and when desired, shoots the firearm by aligning the firearm in a similar fashion as if the player was aiming the firearm to actually fire and actuates the trigger 32. In step 304, the optical system 14 captures the image or images and relevant data concerning the firearm and environment (e.g., alignment and inclination of the bore, any movement of the firearm, winds, altitude, etc.) during the act of shooting (e.g., prior to trigger actuation, during trigger actuation and/or immediately after trigger actuation). In step 306, the captured image and data is transmitted by the transmitter/receiver 16 to the central computing system 118 via the communications link 40.

Next, in step 308, the central computing system receives the transmitted captured image. In step 310, the computing system determines, through its image recognition program, where the virtual bullet would hit relative to the intended target. Furthermore, the computing system may determine if the image is a recognizable and valid target (i.e., a human form) and whether to score it as a hit or a miss. The indicia 22 of the opposing player and/or the detection of infrared emissions (e.g., heat) may be used to further verify the presence of a valid target. Furthermore, modulating retro-reflectors may be optionally utilized to identify or illuminate the target. The computing system may also utilize silhouette extraction techniques to extract an intended target and determine the identity and/or validity of the target. The orientation (e.g., inclination and orientation) of the barrel of the firearm, distance to the target, weather conditions (wind, altitude, etc.), movement of the firearm, distance from firearm to target, etc. may be used to determine the trajectory of the bullet. This information may also be sent to the central computing system. The calculated bullet's trajectory is then used to determine where the bullet would have hit, and from the determination of the bullet's destination, a determination of a hit or miss is accomplished. As discussed above, the firearm may utilize various navigation and motion systems to collect data for accurate determination of the bullet's trajectory and/or location of the player, such as GPS or INS.

Next, in step 312, the central computing system 118 then records the captured image as a hit or a miss based on the image recognition program's determination. In step 314, the management of scores of hits and misses are then compiled by the central computing system. This compilation may be used for debrief of the players and determination of the success of each player and each team. The computing system may compile such data as time of firing, accuracy, number of bullets fired, times the player is targeted, etc. In one embodiment, the computing system may provide a playback of each encounter providing a graphical representation of each player, trajectory of the bullets, etc. In addition, the computing system may capture images which are enhanced by infrared detection or night vision systems enabling optical image pickup in reduced visibility. Additionally, in step 316, the computing system may provide a signal or indication to the intended target of a hit or a near miss.

Although the present invention has illustrated the use of firearms, the present invention may also be incorporated in vehicles, such as tanks, aircraft, watercraft, and armored personnel carriers. The computing system may determine the legitimacy of such targets in its image recognition program.

In addition, the present invention may be used for various scenarios such as within law enforcement field or recreational field.

In another embodiment, the image recognition program and the functionality to determine where a virtual bullet would hit relative to an intended target may reside in the optical system 14 and without the use of a central computing system. FIG. 6 is a block diagram of components of a shooting simulation system 400 in a third embodiment of the present invention. The system includes many of same components and functionalities discussed above with the firearm 12 and the user computer 402, the optical system 14, the display 19, and the wireless transmitter/receiver 16. In one embodiment, each player 20 wears an indicia 22. The system may operate in a similar fashion as discussed above for both the system 10 and system 110 and provide similar functionalities.

As discussed in FIGS. 1 and 2, the optical system aligns where a bullet would travel in front of the firearm and captures an image or images during the act of shooting the firearm. The optical system may capture one or more images at or near trigger actuation, specifically during the act of shooting the firearm. The action of shooting the firearm typically includes the time period prior to trigger actuation for aiming, actuating the trigger, and a momentary time afterward. The optical system may determine that a trigger actuation is imminent in a wide variety of ways, such as utilizing accelerometers to determine when a firearm is motionless, which is typical prior to trigger actuation. Thus, the optical system may determine that trigger is imminent and begin capturing images. If the trigger is not actuated by a predetermined time period, the image or images may then be discarded. The image is then captured and recorded in the image recording device 50. The optical system 14 may be located in the firearm or portions of the optical system, with the exception of the optical image capturing device, may be separate from the firearm but carried by the player (e.g., in the user computer).

In the embodiment illustrated in FIG. 6, ascertaining where the virtual bullet would impact is determined by the shooting firearm's user computer 402. The user computer may be any device having a processor. In one embodiment, the shooting firearm 12 utilizes the image recognition program and the user computer to process the image by determining where the virtual bullet hits. A hit may be defined by predetermined constraints, which may be stored in the user computer for determining a hit.

To facilitate the location of where the virtual bullet would hit, the present invention may optionally utilize indicia 22 or the infrared emissions (e.g., heat) from the target to validate the target. In addition, in a similar fashion as the system 10, information may be obtained from several sources and utilized to verify a hit or miss. In particular, the computer 402 may receive information on the location of each firearm, the heading and inclination of the barrel of the firearm, the distance from the firearm to the target and the location of other firearms. All this geometric information may be used to determine if a hit or miss is to be scored. Furthermore, the optical system may utilize other ancillary identifiers to determine if the intended target is valid, such as detecting specific patterns (e.g., helmet, human face, assault rifle, camouflage clothing, boots, indicia having spectral reflective material, etc.). Additionally, the optical system may emit a laser for use in illuminating and interrogating a target for identification.

In one embodiment, the present invention may utilize modulating retro-reflectors. For example, modulating retro-reflectors may be placed on targets, such as other players, vehicles, buildings, etc. The optical system may utilize a laser 54 (e.g., lidar) or other spectral emitting device to transmit a light beam to the target. The modulating retro-reflectors are illuminated and reflect back a modulated light beam to the receiver of the optical system. The reflected modulated light may be utilized to identify the target. Additionally, the modulating retro-reflectors may be placed on specific areas of the target (e.g., right shoulder) to provide an indicator for placing where the target was hit as well as illuminating the points or portion of the target. The optical system may then extract the target using silhouette extraction techniques. Thus, the modulating retro-reflectors may be utilized to identify a target and/or assist in extracting a silhouette from the image.

With reference to FIGS. 2 and 6, the operation of the system 400 will now be explained. A plurality of players 20 enters an area of operation. Each player carries a firearm 12. In one embodiment of the present invention, each player wears the indicia 22 to facilitate ease in recognition by the optical system's recognition program of a legitimate target and the specific identity of the person. A player observes another player and aligns the firearm in a similar fashion as if the player was aiming the firearm to actually fire. The player, upon determining that the firearm is correctly aimed, actuates the trigger 32. The optical system 14 captures the image or images and any relevant data related to the estimated trajectory of the bullet (e.g., wind, altitude, motion, etc.) during the act of shooting. The optical system and user computer 402 determines, through its image recognition program, where a virtual bullet would impact relative to the intended target and optionally if the image is a recognizable target (e.g., a human form). Furthermore, if the indicia 22 of the targeted player are used, the image recognition program can easily determine the individual player's identity. The optical system then records the captured image as a hit or a miss based on the image recognition programs determination. Furthermore, the user computer 402 may further verify if a hit or miss is to be scored by utilizing the positional information of the firearm firing and the intended target. The management of scores of hits and misses are then compiled by the user computer 402. This compilation may be used for debrief of the players and determination of the success of each player and each team. The user computer 402 may compile such data as time of firing, accuracy, number of bullets fired, times the player is targeted, etc. In one embodiment, the user computer may provide a playback of each encounter providing a graphical representation of each player, trajectory of the bullets, etc. In addition, the user computer may capture images which are enhanced by infrared emissions (e.g., heat), night vision systems, or spectral imaging mechanisms enabling optical image pickup in reduced visibility. In addition, the computer may provide an indication of a hit or miss to the intended target. Specifically, the computer of the shooting firearm may transmit a signal to the target's user computer or optical system providing an indication of a hit or near miss of the target. The target's user computer or optical system may provide an aural or visual indicator (e.g., noise, beep, flashing light) to inform the user of the hit or near miss.

The determination of where the virtual bullet would hit resides within the user computer 402 and may include the use of various forms of data. The inclination of the gun, distance to the target, weather conditions (wind, altitude, etc.), movement of the gun, distance from firearm to target obtained from the rangefinder, etc. are all used to determine the trajectory of the bullet. The calculated bullet's trajectory is then used to determine where the bullet would have hit, and from the determination of the bullet's destination, a determination of a hit or miss of a valid target is accomplished. As discussed above, the computer of the user computer may utilize various navigation and motion systems to collect data for accurate determination of the bullet's trajectory and/or location of the player, such as GPS or INS. Additionally, modulating retro-reflectors may be utilized to illuminate and/or identify the target. In addition, silhouette extraction techniques may be utilized for targeting information.

Figure 7:
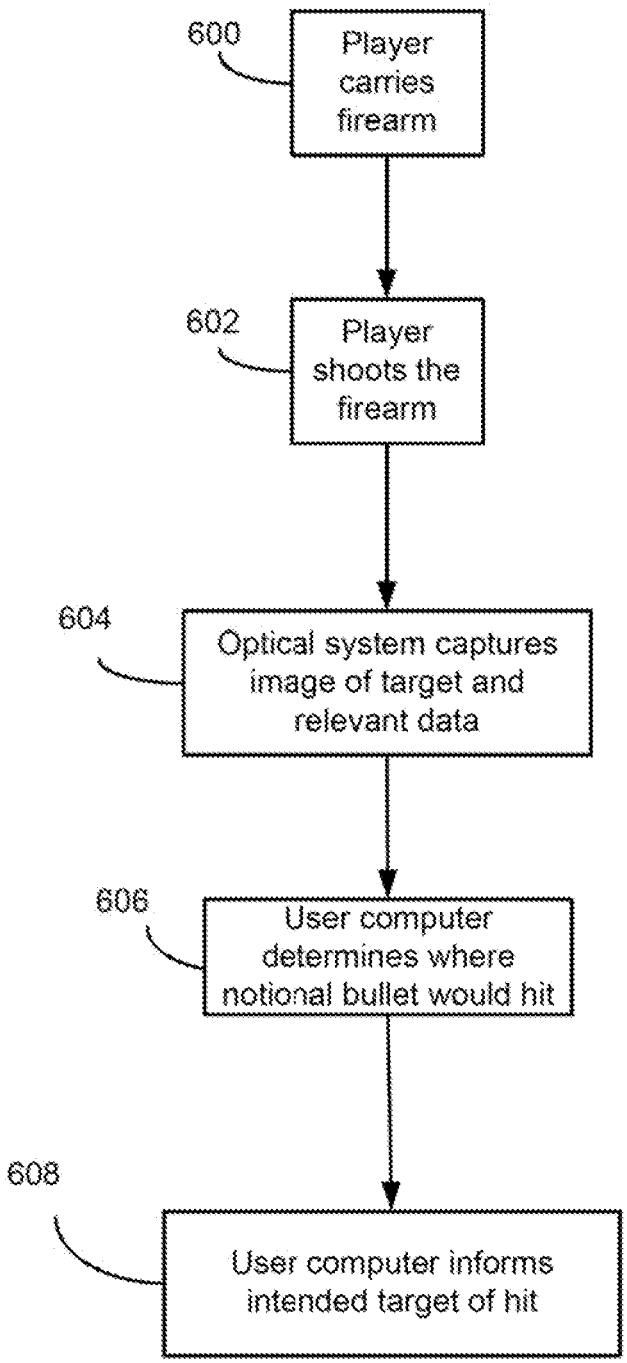
FIG. 7 is a flow chart illustrating the steps of simulating firearm use in another embodiment of the present invention

FIG. 7 is a flow chart illustrating the steps of simulating firearm use in another embodiment of the present invention. With reference to FIGS. 2, 6, and 7 the method will now be explained. In step 600, each player carries a firearm 12 and the user computer 34. In the preferred embodiment of the present invention, each player may wear the indicia 22 to facilitate ease in recognition by the optical system's recognition program of a legitimate target and to which team the player is affiliated. Next, in step 602, a player observes another player and when desired, shoots the firearm by aligning the firearm in a similar fashion as if the player was aiming the firearm to actually fire and actuates the trigger 32. In step 604, the optical system 14 captures the image or images and relevant data concerning the firearm and environment (e.g., alignment and inclination of the bore, any movement of the firearm, winds, altitude, etc.) during the act of shooting (e.g., prior to trigger actuation, during trigger actuation and/or immediately after trigger actuation). In step 606, the user computer 402 determines, through its image recognition program, where the virtual bullet would hit relative to the intended target. Furthermore, the user computer 402 may determine if the image is a recognizable and valid target (i.e., a human form) and whether to score it as a hit or a miss. The indicia 22 of the opposing player may be used to further verify the presence of a valid target. Furthermore, modulating retro-reflectors may be optionally utilized to identify or illuminate points or a portion of the target. The computing system may also utilize silhouette extraction techniques to extract an intended target and determine the identity and/or validity of the target. The orientation (e.g., inclination and elevation) of the barrel of the firearm, distance to the target, weather conditions (wind, altitude, etc.), movement of the firearm, etc. may be used to determine the trajectory of the bullet. This information may also be sent to the central computing system. The calculated bullet's trajectory is then used to determine where the bullet would have hit, and from the determination of the bullet's destination, a determination of a hit or miss is accomplished. As discussed above, the firearm may utilize various navigation and motion systems to collect data for accurate determination of the bullet's trajectory and/or location of the player, such as GPS or INS. Next, in step 608, the user computer 402 may inform the intended target of a hit or near miss.

Figure 8:
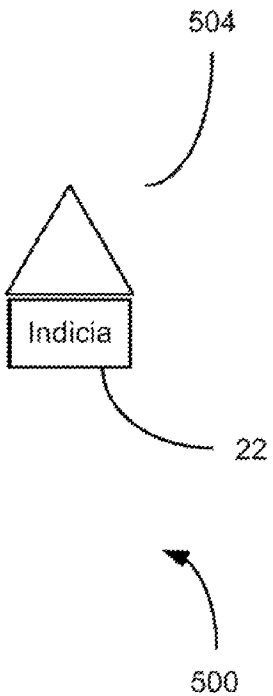
FIG. 8 is a block diagram of components of a shooting simulation system in a fourth embodiment of the present invention.
Figure 8:
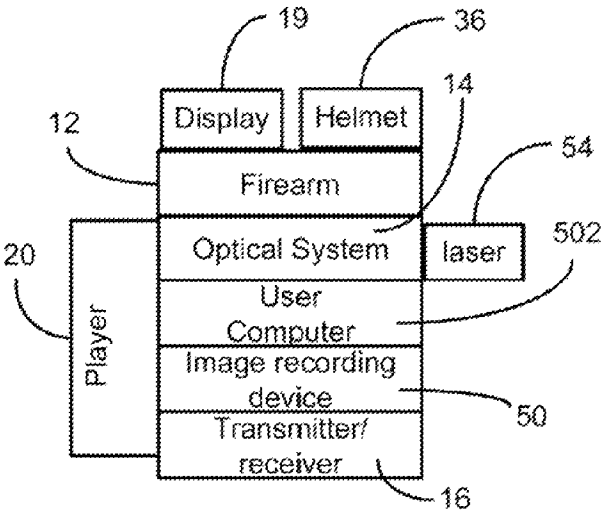

In another embodiment of the present invention, a single user may utilize the same features of the previously discussed embodiments to provide a system for simulated shooting of another person or object. FIG. 8 is a block diagram of components of a shooting system 500 in a fourth embodiment of the present invention. The system includes the firearm 12 and a user computer 502, the optical system 14, and the wireless transmitter/receiver 16. In this embodiment, a single player 20 simulates shooting at another object or person, or target 504.

In a similar fashion as discussed in FIG. 6, the optical system aligns where a bullet would travel in front of the firearm and captures an image or images during the act of shooting the firearm. The action of shooting the firearm typically includes the time period prior to trigger actuation for aiming, actuating the trigger, and a momentary time afterward. The optical system may determine that a trigger actuation is imminent in a wide variety of ways, such as utilizing accelerometers to determine when a firearm is motionless, which is typical prior to trigger actuation. Thus, the optical system may determine that trigger is imminent and begin capturing images. If the trigger is not actuated by a predetermined time period, the image or images may then be discarded. The image or images are then captured and recorded in the image recording device 50. The optical system 14 may be located in the firearm or portions of the optical system, with the exception of the optical image capturing device, may be separate from the firearm but carried by the player (e.g., in the user computer).

In the embodiment illustrated in FIG. 8, ascertaining where a virtual bullet hits in relation to an intended target is determined by the shooting firearm's user computer 502. The user computer may be any device having a processor. In one embodiment, the shooting firearm 12 utilizes the image recognition program within the optical system 14 to process the image by determining where the virtual bullet hits relative to the intended target. Additionally, the image recognition program may utilize motion of the object to determine if the target is a legitimate target. For example, the motion of an airborne bird may be used for identifying the target as a legitimate target (if a bird is a target).

To facilitate where a virtual bullet hits, the present invention may optionally utilize indicia 22 of the target 504 or the infrared emissions (e.g., heat) from the target to validate the target. In addition, in a similar fashion as the system 10, information may be obtained from several sources and utilized to verify a hit or miss. In particular, the computer 502 may receive information on the location of the firearm, the heading and inclination of the barrel of the firearm, the distance from the firearm to the target and the location of other firearms. All this geometric information may be used to determine if a hit or miss is to be scored. A hit may be defined by predetermined constraints, which may be stored in the user computer for determining a hit.

In addition, the present invention may utilize modulating retro-reflectors. For example, modulating retro-reflectors may be placed on targets, such as other players, vehicles, buildings, etc. The optical system may utilize a laser 54 (e.g., lidar) or other spectral emitting device to transmit a light beam to the target. The modulating retro-reflectors are illuminated and reflect back a modulated light beam to the receiver of the optical system. The reflected modulated light may be utilized to identify the target. Additionally, the modulating retro-reflectors may be placed on specific areas of the target (e.g. right shoulder) to provide an indicator for placing where the target was hit. Additionally, the modulating retro-reflectors may be used to assist in illuminating points or a portion of a target, especially in low light scenarios. In such a circumstance, the laser illuminates the modulating retro-reflectors which then illuminate points or a portion of the target. The optical system may then extract the target using silhouette extraction techniques. Thus, the modulating retro-reflectors may be utilized to identify a target and/or assist in extracting a silhouette from the image.

With reference to FIGS. 2 and 8, the operation of the system 400 will now be explained. A player 20 enters an area of operation carrying a firearm 12. The target 504 may wear the indicia 22 to facilitate ease in identifying the target and determining where the virtual bullet hits by the optical system's recognition. A player observes the target and aligns the firearm in a similar fashion as if the player was aiming the firearm to actually fire. The player, upon determining that the firearm is correctly aimed, actuates the trigger 32. The optical system 14 captures the image or images and any relevant data related to the estimated trajectory of the bullet (e.g., wind, attitude, motion, etc.) during the act of shooting. The optical system and user computer 502 determines, through its image recognition program, where a virtual bullet would impact relative to the target and may determine if the image is a recognizable target. Furthermore, if the indicia 22 of the target are used, the image recognition program can easily determine the target's identity. The optical system may then determine if a hit or a miss should be recorded based on the image recognition programs determination. Furthermore, the user computer 502, or alternately a central computing system (not shown in FIG. 7), may further verify if a hit or miss is to be scored by utilizing the positional information of the firearm firing and the intended target. The management of scores of hits and misses are then compiled by the user computer 502.

The determination of where the virtual bullet hits may be made within the user computer 402 by utilizing various forms of data. The inclination of the gun, distance to the target, weather conditions (wind, altitude, etc.), movement of the gun, distance from firearm to target obtained from the rangefinder, etc. are all used to determine the trajectory of the bullet. The calculated bullet's trajectory is then used to determine where the bullet would have hit, and from the determination of the bullet's destination, a determination of a hit or miss of a valid target is accomplished. As discussed above, the computer of the user computer may utilize various navigation and motion systems to collect data for accurate determination of the bullet's trajectory and/or location of the player, such as GPS or INS.

In addition, the central computing system or user computer may vary the parameters defining a valid hit. For example, a hit may be reduced to a smaller concentric circle for which a hit is scored. Additionally, the central computer or the user computer may provide a handicap based on previous performance of the player for the determination of a hit.

In the embodiment of FIG. 8, the player 20 does not require the target to be using any optical recognition program or computers. The results may be sent to a display unit or other device showing the results (e.g., virtual bullet holes). For example, the results may be displayed on a template of a target or a target representation. The present invention may be utilized for target practice of inanimate objects or any person. Blasts and flashes may be emitted from the firearm. In addition, spectral radiation may be emitted forward of the firearm. The target may have indicia having spectral reflective material. The emitted spectral radiation may then be reflected and provided as an indicator to the user computer that the target is a valid target. Furthermore, a replica firearm or an actual firearm may be utilized with the components of the system 500.

In another embodiment of the present invention, the systems described in FIGs. 1, 4, and 6 may utilize a distributed network. In this network, the firearm (user computer) communicates with one or more firearms (user computer) using the wireless transmitter/receivers 16. Any necessary information is passed from one node (i.e., firearm or user computer) to another without the need of a centralized computing system. In one embodiment, the wireless transmitter/receiver enables the use of a wireless network for communicating between each firearm/user computer. In another alternate embodiment of the present invention, the system 500 may utilize a central computing system (not shown in FIG. 8). The image recognition program may reside with the central computing system or with the firearm 12. Furthermore, the hit or miss determination may be made either in the central computing system or the firearm as discussed in FIGS. 1 and 4.

The various components (e.g. parts of the optical system, wireless transmitter/receiver, image recording device, etc.) associated with each firearm in systems 10, 110, 400, and 500 may be worn by the player or integrated into the firearm. For example, the user computer may be a separate component worn by the player and communicating with the firearm or may be integrated into the firearm. Furthermore, the firearm may be incorporated with a vehicle, either manned or unmanned.

The present invention provides many advantages over existing shooting simulation systems. The present invention does not require the wearing of sensors by players to detect a hit by a laser or other device. Furthermore, the targeted player does not need to emit an active electronic emission and may be a passive target. Additionally, in one embodiment, the shooting firearm does not need to emit any spectral emissions to determine if the image is a legitimate target. Thus, the cost of equipment is drastically reduced. Furthermore, the present invention enables the accurate calculation of a bullet's trajectory rather than the straight line of sight calculation used in laser simulation systems. In addition, the present invention provides for the carriage of light weight and cost-effective equipment (i.e., an optical system) for use on the firearm. The present invention may be incorporated in existing operational firearms or built into realistic replicas. Additionally, the present invention may be utilized for bore sighting or zeroing a weapon.

The present invention may be utilized between two players, a single person against another target, a vehicle (including a tank, watercraft, aircraft, or surface vehicle) and another target, etc. The present invention may utilize lasers or other light beams to illuminate or identify a target using modulating retro-reflectors.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A shooting simulation system, the system comprising:

a plurality of firearms, each firearm associated with a separate player, wherein each player has a user computer and an optical system associated with the firearm for capturing an image, the image providing information on a trajectory of a virtual bullet fired from a shooting firearm;

wherein the optical system is aligned relative to a known sight of the shooting firearm, the optical system capturing the image when shooting the firearm; and an image recognition system for determining if the captured image is a legitimate target;

wherein the user computer determines if the captured image is a hit or a miss of a targeted player, the user computer using information obtained from the optical system and image recognition system for determining if the captured image is a hit or a miss of a targeted player, wherein the optical system detects a predetermined indicia of the targeted player to determine if the targeted player is a legitimate target;

wherein the indicia identifies the player and is configured to be worn by the player.

2. The system according to claim 1 wherein each player wears the indicia for identifying the player.

3. The system according to claim 2 wherein the indicia provides positional information on where the virtual bullet would impact.

4. The system according to claim 2 wherein:

the indicia is a modulating retro-reflector; and the optical system includes a receiver for receiving signals reflected from the modulating retro-reflector.

5. The system according to claim 4 wherein:

the optical system is configured to emit a laser beam;

the modulating retro-reflector is configured to modulate and reflect the emitted laser beam to the receiver of the optical system, the modulated laser beam providing information to the user computer.

6. The system according to claim 5 wherein the modulated laser beam provides information on the identity of a target associated with the modulating retro-reflector.

7. The system according to claim 4 wherein the modulating retro-reflector is configured to illuminate points or a portion of a target associated with the modulating retro-reflector.

8. The system according to claim 1 wherein the optical system captures a plurality of images during the act of shooting.

9. The system according to claim 1 wherein the optical system includes a laser which emits a laser beam.

10. The system according to claim 1 wherein:

the optical system includes a receiver for receiving reflected signals from a target; and the laser provides a ranging function to determine a distance to the reflected target.

11. The system according to claim 1 wherein a hit or miss is determined by predetermined constraints defining a hit stored in the user computer.

12. The system according to claim 1 wherein the optical system projects spectral radiation to illuminate a target.

13. The system according to claim 1 wherein the optical system captures an image prior to a trigger actuation.

14. The system according to claim 1 further comprising a central computing system communicating with all the user computers.

15. The system according to claim 1 wherein the optical system captures an image after trigger actuation.

16. The system according to claim 1 wherein at least one firearm is affixed to a vehicle.

17. A method of simulating firearm use, the method comprising the steps of:

shooting a firearm, wherein the step of shooting includes aiming at a target and triggering the firearm;

capturing an image during the step of shooting by an optical system associated with the shooting firearm;

providing information on a trajectory of a virtual bullet fired from a shooting firearm by the captured image; and determining if the captured image is a valid hit or miss of the target, wherein the step of determining if the captured image is a valid hit or miss of the target includes the steps of:

using an image recognition system for determining if the captured image is a legitimate target;

using information obtained from the optical system and image recognition system for determining if the captured image is a hit or a miss of the target and detecting a predetermined indicia associated with the target, wherein the optical system detects the predetermined indicia to determine if the target is a legitimate target.

18. The method according to claim 17 further comprising the step of determining if the captured image is a hit or a miss of the target.

19. The method according to claim 18 wherein the step of determining if the captured image is a hit or a miss of the target includes the step of using information obtained from the optical system and image recognition system for determining if the captured image is a hit or a miss of the target.

20. The method according to claim 17 further comprising the step of affixing the indicia to the target.

21. The method according to claim 20 wherein the indicia provides positional information on where the virtual bullet would impact.

22. The system according to claim 20 wherein the indicia is a modulating retro-reflector.

23. The method according to claim 22 wherein:

the optical system is configured to emit a laser beam;

the modulating retro-reflector is configured to modulate and reflect the emitted laser beam;

the optical system is configured to receive reflected laser beams, the reflected laser beam providing information to the user computer.

24. The method according to claim 23 wherein the modulated laser beam provides information on the identity of a target associated with the modulating retro-reflector.

25. The method according to claim 22 wherein the modulating retro-reflector is configured to illuminate a point or a portion of a target associated with the modulating retro-reflector.

26. The method according to claim 17 further comprising the step of emitting a laser beam from a laser affixed to the optical system.

27. The method according to claim 26 wherein:

the optical system includes a receiver for receiving reflected signals from a target; and the laser provides a ranging function to determine a distance to the reflected target.

28. The method according to claim 26 wherein the laser beam illuminates a point or portion of the target.

29. The method according to claim 17 wherein at least one firearm is affixed to a vehicle.

30. The method according to claim 17 further comprising the steps of:

verifying a hit or miss for each captured image by a central computing system communicating with a user computer of the firearm; and compiling hits or misses of the firearm in use by the central computing system.

31. The method according to claim 17 further comprising the step of detecting a predetermined indicia associated with the target, wherein an optical system detects the predetermined indicia in the captured image to determine an identity of the target.

32. The method according to claim 17 further comprising the step of informing an intended target of a hit of the virtual bullet.

33. A simulated shooting system, the system comprising:

a firearm associated with a user having a user computer and an optical system for capturing an image, the image providing information on a trajectory of a virtual bullet fired from the firearm;

wherein the optical system is aligned relative to a known sight of the shooting firearm, the optical system capturing the image when shooting the firearm; and an image recognition system for determining if the captured image is a legitimate target;

wherein the computer determines if the captured image is a hit or a miss of a target, the computer using information obtained from the optical system and image recognition system for determining if the captured image is a hit or a miss of the target, wherein the optical system detects a predetermined indicia of the target to determine if the target is a legitimate target.

34. The system according to claim 33 wherein the user computer determines from the determined location of the virtual bullet if the captured image is a hit or a miss of a target, the user computer using information obtained from the optical system and image recognition system for determining if the captured image is a hit or a miss of a target.

35. The system according to claim 33 wherein the target is affixed with the indicia for identifying the target.

36. The system according to claim 35 wherein the indicia provides positional information on where the virtual bullet would impact.

37. The system according to claim 35 wherein:

the indicia is a modulating retro-reflector; and the optical system includes a receiver for receiving signals reflected from the modulating retro-reflector.

38. The system according to claim 37 wherein:

the optical system is configured to emit a laser beam;

the modulating retro-reflector is configured to modulate and reflect the emitted laser beam to the receiver of the optical system, the modulated laser beam providing information to the user computer.

39. The system according to claim 38 wherein the modulated laser beam provides information on the identity of a target associated with the modulating retro-reflector.

40. The system according to claim 37 wherein the modulating retro-reflector is configured to illuminate a point or a portion of a target associated with the modulating retro-reflector.

41. The system according to claim 37 wherein the optical system captures a plurality of images during the act of shooting.

42. The system according to claim 33 wherein the optical system includes a laser which emits a laser beam.

43. The system according to claim 33 wherein:

the optical system includes a receiver for receiving reflected signals from a target; and the laser provides a ranging function to determine a distance to the reflected target.

44. The system according to claim 33 wherein a hit or miss is determined by predetermined constraints defining a hit stored in the user computer.

45. The system according to claim 33 wherein the firearm projects spectral radiation to illuminate a target.

46. The system according to claim 33 wherein the optical system captures an image prior to a trigger actuation.

47. The system according to claim 33 further comprising a central computing system communicating with all the user computers.

48. The system according to claim 33 wherein at least one firearm is affixed to a vehicle.

49. The system according to claim 33 wherein the target is an inanimate object.

50. The system according to claim 33 wherein the optical system is configured for bore sighting the firearm.

51. The system according to claim 33 wherein the optical system captures an image after trigger actuation.

* * * * *